US010246958B2

(12) United States Patent
MacGregor et al.

(10) Patent No.: US 10,246,958 B2
(45) Date of Patent: Apr. 2, 2019

(54) VALVE ASSEMBLY

(71) Applicant: MANAGED PRESSURE OPERATIONS PTE. LTD., Singapore (SG)

(72) Inventors: Alexander John MacGregor, Kirkcudbright (GB); Christian Leuchtenberg, Singapore (SG); James Bisset, Dubai (AE)

(73) Assignee: MANAGED PRESSURE OPERATIONS PTE, LTD., Singapore (SG)

( * ) Notice: Subject to any disclaimer, the term of this patent is extended or adjusted under 35 U.S.C. 154(b) by 514 days.

(21) Appl. No.: 14/772,267

(22) PCT Filed: Mar. 5, 2014

(86) PCT No.: PCT/GB2014/050651
§ 371 (c)(1),
(2) Date: Sep. 2, 2015

(87) PCT Pub. No.: WO2014/135873
PCT Pub. Date: Sep. 12, 2014

(65) Prior Publication Data

US 2016/0002993 A1 Jan. 7, 2016

(30) Foreign Application Priority Data

Mar. 6, 2013 (GB) ..... 1303986.2

(51) Int. Cl.
*E21B 21/00* (2006.01)
*E21B 37/08* (2006.01)
*E21B 21/10* (2006.01)
*E21B 34/08* (2006.01)
*E21B 19/16* (2006.01)

(52) U.S. Cl.
CPC ..... *E21B 21/106* (2013.01); *E21B 19/16* (2013.01); *E21B 21/103* (2013.01); *E21B 34/08* (2013.01)

(58) Field of Classification Search
CPC ..... E21B 21/103; E21B 34/08
See application file for complete search history.

(56) References Cited

U.S. PATENT DOCUMENTS

| | | | | |
|---|---|---|---|---|
| 2,158,356 A | | 5/1939 | Dyer | |
| 3,967,679 A | | 7/1976 | Liljestrand | |
| 5,713,389 A | | 2/1998 | Wilson, Jr. et al. | |
| 6,119,772 A | | 9/2000 | Pruet | |
| 6,142,037 A | * | 11/2000 | Botosan | F16H 61/0276 137/543.13 |

(Continued)

FOREIGN PATENT DOCUMENTS

| | | | |
|---|---|---|---|
| CA | 2 587 752 | A1 | 11/2008 |
| CN | 102378847 | A | 3/2012 |

*Primary Examiner* — Giovanna C. Wright
(74) *Attorney, Agent, or Firm* — Norman B. Thot

(57) ABSTRACT

A valve assembly for use controlling flow of fluid into a drill pipe, the valve assembly having a valve body, a valve member and a valve seat, wherein a) the valve body has a main passage b) the valve member is movable between a closed position in which the valve member engages with a seat face of the valve seat to substantially prevent flow of fluid along the main passage, and an open position in which the valve member is spaced from the seat face, c) the valve seat is a separate part to the valve body.

22 Claims, 4 Drawing Sheets

(56) References Cited

U.S. PATENT DOCUMENTS

Figure 1:
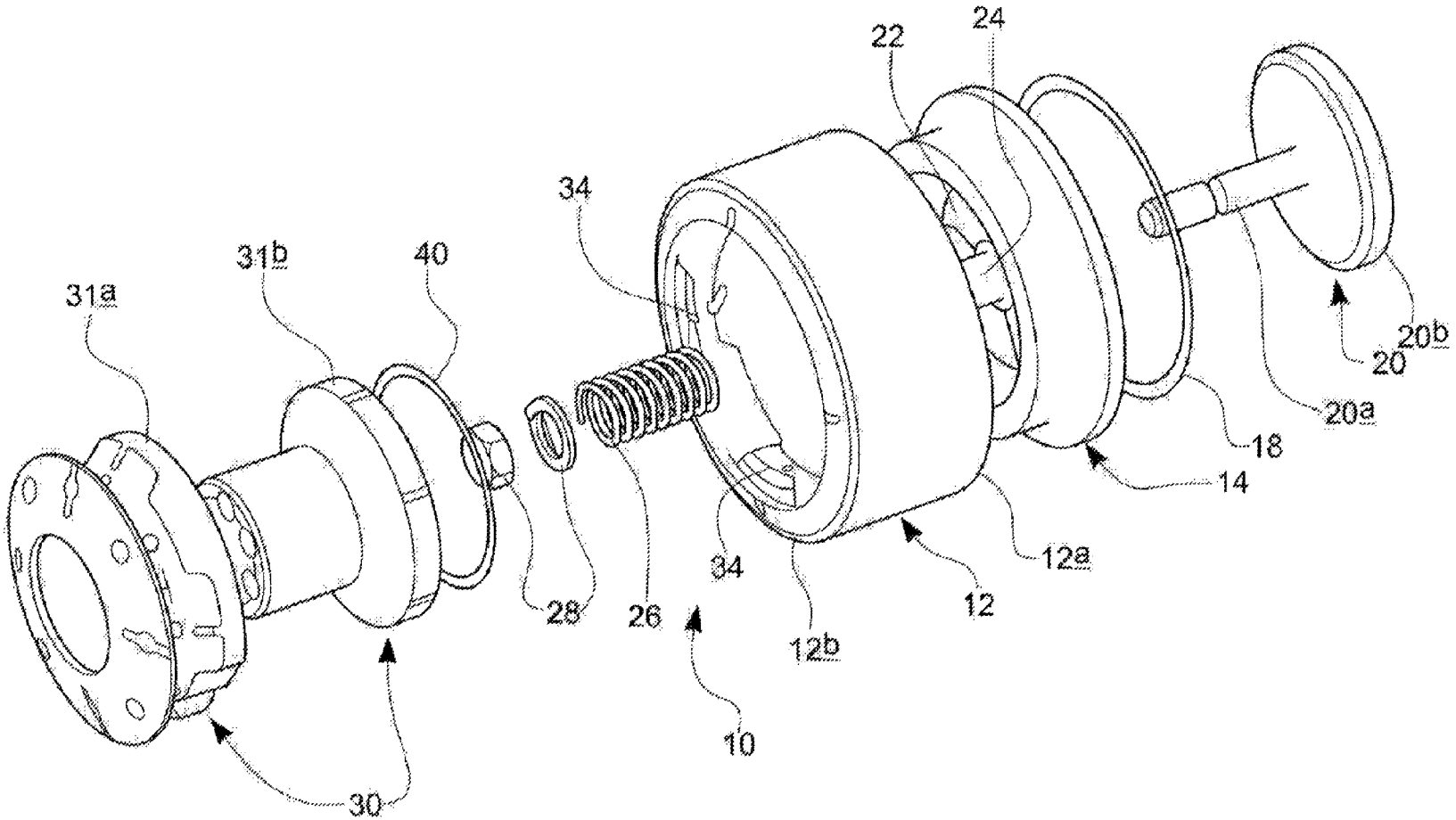

| | | | | |
|---|---|---|---|---|
| 6,412,554 | B1 | 7/2002 | Allen et al. | |
| 7,252,151 | B2 | 8/2007 | Ayling | |
| 7,322,418 | B2 | 1/2008 | Ayling | |
| 8,016,033 | B2 | 9/2011 | Iblings et al. | |
| 8,210,266 | B2 | 7/2012 | Younger et al. | |
| 2005/0286990 | A1* | 12/2005 | Koppenhoefer | E21B 33/03 411/432 |
| 2007/0181188 | A1 | 8/2007 | Branch et al. | |
| 2010/0096190 | A1* | 4/2010 | Younger | E21B 19/16 175/218 |
| 2011/0308860 | A1 | 12/2011 | deBoer | |
| 2012/0090853 | A1 | 4/2012 | Leuchtenberg et al. | |
| 2012/0138298 | A1* | 6/2012 | Giroux | E21B 4/02 166/289 |

* cited by examiner

VALVE ASSEMBLY

The present invention relates to a valve assembly, in particular to a valve assembly for use continuous circulation drilling.

The drilling of a wellbore is executed through the rotation of a drill bit at the base of a drill string. The drill string mainly consists of individual joints of pipe that are joined to one another via threaded connections on each end.

The rotation of the drill bit is a critical function in breaking through layers of subsurface formation and ultimately achieving a desired target depth. In order to rotate the drill bit, a rotary table or top drive is commonly utilized to provide torque to the drill string which will result in the rotation of the drill bit below. Drill bit rotation can also be achieved independently of drill string rotation via a down hole motor that is energized by the flow of drilling fluid down the drill string.

In either rotational strategy, the drilling fluid is ultimately circulated down the drill string, through the drill bit, and up through the annulus of the wellbore. This flow of drilling fluid serves to provide sufficient bottom hole cleaning, cuttings transportation, and cooling of the drill bit. The drilling fluid is also expected to provide wellbore stability by creating enough pressure in the annulus to prevent an unexpected influx of formation fluid and also prevent wellbore collapse. Drilling fluid can represent a broad range of mixtures consisting of oil, synthetic, or water based fluids that contain varying amounts of solids content as well as aerated liquids, foam, mists, and inert gas.

A significant amount of pressure is required to circulate drilling fluid along the path described above at the rates needed to successfully provide the desired levels of bottom hole cleaning, cuttings transport, and well bore pressure. As a result, positive displacement pump(s) are commonly deployed to inject drilling fluid through the standpipe manifold and down the top of the drill string with a top drive or kelly serving as a segment of the flow conduit. The positive displacement pumps are typically referred to as mud pumps, and provide the necessary mechanical force to move the fluid throughout the entire drilling system.

As the depth of a borehole increases, additional sections of pipe must be added to the top of the drill string in order to permit the drill bit to continue progressing toward a desired target. Alternatively, when pulling the drill bit out of the hole, sections of pipe must be removed from the drill string. Traditionally, the process of adding drill pipe has been performed by stopping the circulation of drilling fluid, disconnecting the top drive from the drill string, adding a length of a pipe, reconnecting the top drive to the top of the drill string, and restarting the circulation of drilling fluid.

The termination of fluid circulation during the process described above creates challenges in drilling that can be addressed via a continuous circulation system in which circulation does not cease. In one such proposal, the flow of drilling fluid is diverted entirely away from the top drive and directed toward a side port in the drill string. The side port provides an alternative flow path into the main bore of the drill string. In doing so, circulation can continue without interruption through the side port, while the top of the drill string is closed and the top drive is disconnected in order to add another section of pipe. This flow diversion can be executed by means of a one-way valve positioned in the side port with a connection for a hose that receives a pressurized fluid flow from the rig mud pumps via the standpipe manifold. Flow of drilling fluid can also be fully diverted back through the top of the drill string once the top drive is reconnected.

In one embodiment of such a system, disclosed in U.S. Pat. No. 8,210,266 B2, a poppet check valve is mounted in a generally cylindrical valve housing which is located within a side port in the wall of the drill string (illustrated in FIGS. 5*a*, 5*b*, 5*c*, 5*d*6*a*, 6*b*, 6*c*, and 6*d*). The side port is normal to the direction of the main bore of the drill string. The cylindrical valve housing is secured in place by means of a threaded engagement with the side port of the drill string. The cylindrical valve housing could also be secured in place with locking pins that extend through apertures in the housing into the drill string body. These locking pins prevent the valve housing from being backed out. Bolts or any other appropriate means of fastening the valve housing to the side port can also be used. The valve housing also contains a central bore that is parallel to the side bore which contains the poppet check valve. An O-ring is used to create a fluid tight seal between the cylindrical valve housing and the drill string body.

The poppet member includes a stem on one end mounted in a perpendicular fashion to a cylindrical disk. A circular valve seat is located on the outside of the cylindrical valve housing. The stem protrudes into the bore of the valve housing while the cylindrical disk, which is slightly wider than the inner diameter of the bore of the housing, sits on the valve seat when in the closed position. A metal-metal seal is formed between the valve seat and cylindrical disk in the closed valve position. This metal-metal seal serves a primary barrier to prevent fluid from flowing out of the drill string and back through the valve housing during drilling periods with the continuous circulation system disconnected. Additionally, the flush positioning of the poppet style valve assembly entirely within the side bore has the advantage of not obstructing flow through the main bore of the drill string.

In order to locate the valve member radially within the bore of the valve housing, an annular flange is provided which extends from the valve housing with metal spokes into a central aperture that is slightly wider than the diameter of the valve stem. The valve stem extends through the central aperture. The valve is biased in a closed position via a spring which extends between a circular groove provided in the annular flange out towards the free end of the stem in which it is fastened by a castellated nut or other mechanical nut designs. In order to push the poppet into the open position, one must overcome the force of the spring thereby lifting the cylindrical disk off the circular valve seat. In doing so, fluid can flow through the bore of the valve housing, around the spokes in the annular flange, and into the main bore of the drill string through the space between the disk and valve seat. Such a force can be deployed via the flow of pressurized fluid from the mud pumps and through a hose that can be connected from the standpipe flow manifold to the valve housing in the side port of the drill string.

When the valve is not transmitting flow through the side port, the bore of the cylindrical valve housing may be protected with a protective cap assembly that offers a secondary seal. In one embodiment of the invention, the cap consists of a two part structure. The outer cap structure slides into the bore of the valve housing until bayonet connections engage with lip formations on the cylindrical housing to secure the assembly into place. The inner cap structure is fastened to the inside of the outer cap structure via the engagement of a screw thread. The inner cap structure creates a secondary seal with the inner surface of the valve housing via an O-ring. This secondary seal provides an additional barrier in the event that the valve seat and cylindrical disk fail to provide an adequate metal-metal seal. A connection assembly is used to install and remove the cap.

The invention may be used in conjunction with another valve that secures the top of the main bore of drill pipe.

Other examples of continuous circulation systems are disclosed in U.S. Pat. Nos. 7,252,151, 7,322,418, 6,412,554, and 6,119,772, but these feature highly complex mechanical-hydraulic systems containing multiple rams that are expensive, involve complex designs and maintenance, and occupy large amounts of work space on the rig floor. The apparatus disclosed in US patent application 2011/0308860 does not provide the opportunity to replace frequently worn metallic components in the bore of the valve. Additionally, this apparatus locates a valve member in the main flow path of the drill string subjecting the valve to intensive erosion. U.S. Pat. No. 8,016,033 B2 also proposes a side-port based circulation system that involves a valve located in the direct flow path of the main bore of the drill string subjecting the system to intensive erosion. Finally, U.S. Pat. No. 2,158,356 proposes a side bore circulation system with a flapper valve. The use of a flapper valve traditionally does not provide a robust, high pressure seal.

The embodiment of the invention described above in U.S. Pat. No. 8,210,266 B2 addresses many of the disadvantages seen in current continuous circulation systems. The primary and secondary barrier seal mechanisms provide increased assurance that pressurized fluid flow through the main bore of the drill string will not escape the drill string via the side port. The protective cap allows the release of any trapped pressure to indicate if the seals are working and protect crewmen. In the event of a primary barrier failure, the locking system on the protective cap will not allow the cap to be released. The design also secures the valve assembly into the side port with a pressure tight seal via a threaded engagement between the external surface of the valve housing and the internal surface of the side port wall, or locking pins that grasp the drill string body, and an O-ring. The poppet valve provides a more robust seal than a flapper valve. Additionally, the design does not obstruct the flow path in the main bore of the drill string. Finally, the use of the proposed continuous circulation valve is far more simple than the highly complex and costly designs that deploy the use of rams and annular preventers to conduct the continuous circulation process.

The present invention seeks to address one or more of the problems associated with the valve assembly shown in U.S. Pat. No. 8,210,266 and described above.

According to a first aspect of the invention we provide a valve assembly for use controlling flow of fluid into a drill pipe, the valve assembly having a valve body, a valve member and a valve seat, wherein a) the valve body has a main passage b) the valve member is movable between a closed position in which the valve member engages with a seat face of the valve seat to substantially prevent flow of fluid along the main passage, and an open position in which the valve member is spaced from the seat face, c) the valve seat is a separate part to (not integral with) the valve body.

By virtue of making the valve seat separate to the valve body, the valve seat may be replaced, if damaged through erosion or corrosion for example, without the need to replace the valve body too.

At least the portions of the seat face and valve member which engage when the valve member is in the closed position may be metallic. In other words, the engagement of the seat face and the valve member forms a metal-to-metal seal. The valve member may be provided with an additional non-metallic sealing element (for example a polyurethane seal) which also engages with the seat face when the valve member is in the closed position.

The valve assembly may include a cap and the valve body may be provided with cap locking formations suitable for engagement with corresponding locking formations provided on the cap when the cap is located at least partially in the main passage, the engagement of these locking formations substantially preventing movement of the cap out of the main passage. The valve seat may have a further seat face which engages with a sealing part of cap to provide a substantially fluid tight seal when the cap is retained in the main passage of the valve body by engagement of its locking formations with the cap locking formations of the valve body.

The valve body may be provided with means for securing the valve body in an aperture provided in a drill pipe. This may comprise a screw thread on the exterior surface of the valve body.

The valve member may be predominantly surrounded by the valve body and valve seat.

The valve member may be movable between the closed position and the open position by translational movement.

The valve seat may be located at a first end of the valve body.

The valve seat may have a first portion which extends into the main passage of the valve body, and a second portion which engages with the first end of the valve body. In this case, the first portion of the valve seat may engage with an interior surface of the valve body.

The valve seat may be provided with a support part for locating the valve member at least partially within the main passage.

The valve seat may be generally annular, and the support part may comprise at least one spoke which extends radially into the generally circular space enclosed by the valve seat.

The seat face may face away from the valve body.

The seat face may be generally annular and be oriented at an angle of between 30 and 60° to the longitudinal axis of the main passage.

According to a second aspect of the invention we provide a drilling system including a tubular element and a valve assembly having any feature or combination of features of the valve assembly of the first aspect of the invention.

The tubular element may have a wall enclosing a main passage and a side port which extends through the wall from the exterior of the tubular element to the main passage, in which case the valve assembly may be mounted on or at least partially within the side port so that movement of the valve member to the closed position substantially prevents flow of fluid through the side port.

The valve body may include anchor formations which are engaged with corresponding formations on the tubular element to restrict movement of the valve body relative to the tubular element. These formations may comprise a screw thread.

The valve seat may have a sealing face which is in sealing engagement with the drill pipe to substantially prevent flow of fluid from the main passage in the tubular element between the valve assembly and the tubular element.

The side port may include a larger cross-sectional area portion and a smaller cross-sectional area portion, there being a shoulder in the portion of the wall of the tubular element surrounding the side port which extends between the larger cross-sectional area portion and the smaller cross-sectional area portion. In this case, maximum outer diameter of valve assembly may be less than the diameter of the larger cross-sectional area portion and greater than the diameter of the smaller cross-sectional area portion. The valve seat may engage with the shoulder so that the shoulder supports the valve assembly in the side port, a substantially fluid tight seal being provided between the shoulder and the valve seat. The valve seat may be clamped between the valve body and the shoulder. The shoulder may extend generally perpendicular to the longitudinal axis of the side port.

The valve body may be located between the valve seat and the exterior of the tubular element.

The tubular element may be a drill pipe or sub.

According to a third aspect of the invention we provide an assembly comprising a rod having a longitudinal axis, a support part, a resilient biasing element, and a nut, the nut being mounted on a screw thread around the rod, the assembly further comprising a locking collar which is mounted around the rod such that the biasing element extends between the support part and the locking collar, the locking collar having a first locking formation which engages with a corresponding locking formation of the rod to substantially prevent rotation of the locking collar around the rod, the biasing element pushing the locking ring into engagement with the nut so that at least one locking formation on the nut engages with a second locking formation on the locking collar, and, as a result, the locking collar substantially prevents further rotation of the nut about the rod.

The locking formation of the nut may comprise two or more teeth or castellations extending from the nut generally parallel to the longitudinal axis of the rod.

The locking formation of the rod may comprise a slot extending along an end of the rod generally parallel to its longitudinal axis, whilst the first locking formation of the collar comprises a protruberance or tab which extends radially inwardly of the locking collar into the slot.

The first and second locking formations of the locking collar may be integrally formed in a single part of the locking collar. They may, for example, both be a part of the tab.

The biasing element may comprise a helical spring.

According to a fourth aspect of the invention we provide a valve assembly comprising a valve seat and a valve member which is movable into and out of engagement with the valve seat to open or close the valve assembly, and an assembly according to the fourth aspect of the invention and having any feature or combination of features of the assembly according to the fourth aspect of the invention, wherein the valve member comprises the rod, the support part is fixed relative to the valve seat, and the biasing element biases the valve member into or out of engagement with the valve seat.

Preferably the valve member is biased into engagement with the valve seat by means of the resilient biasing element.

The valve member may further comprise a disc which is mounted on one end of the rod so that the rod extends centrally from and generally normal to the disc. In this case, the valve assembly may be configured such that it is the disc that engages with the valve seat when the valve member is engaged with the valve seat.

Figure 2:
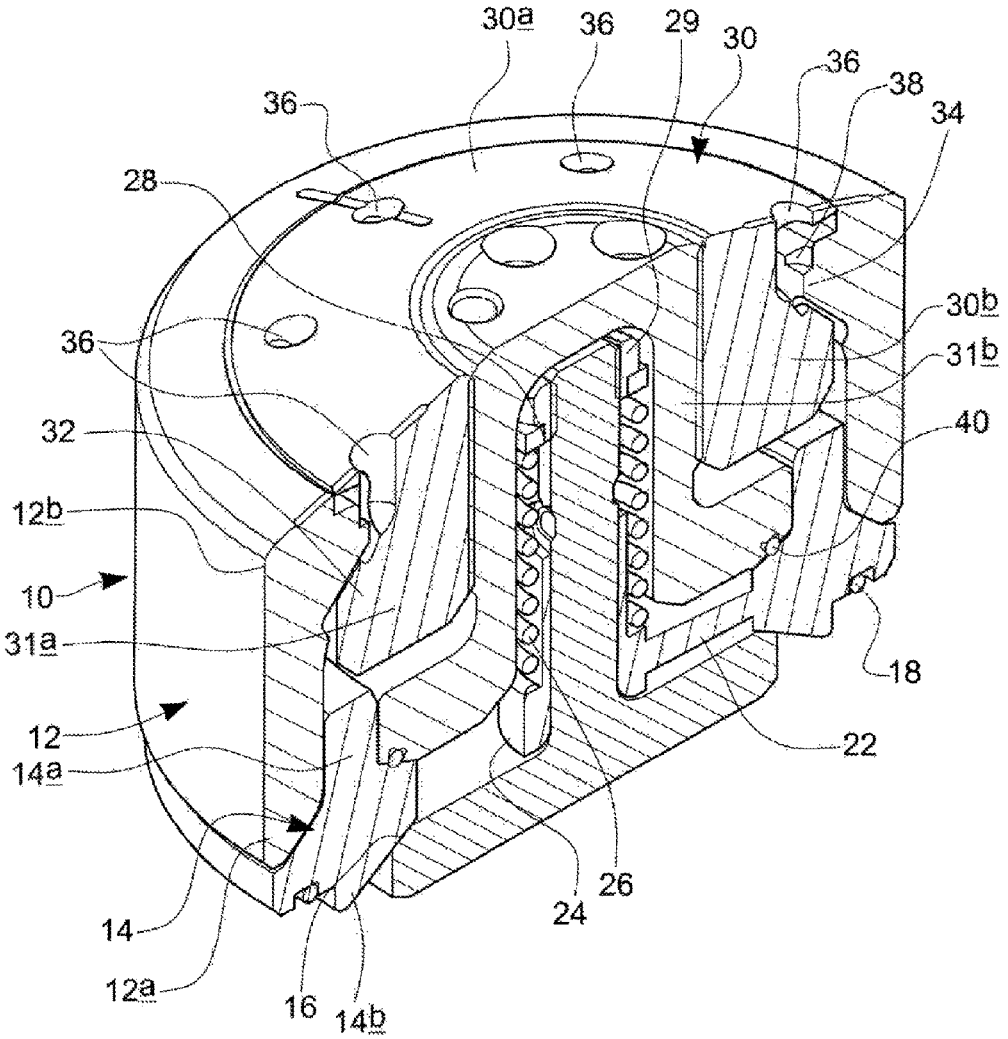
Figure 3:
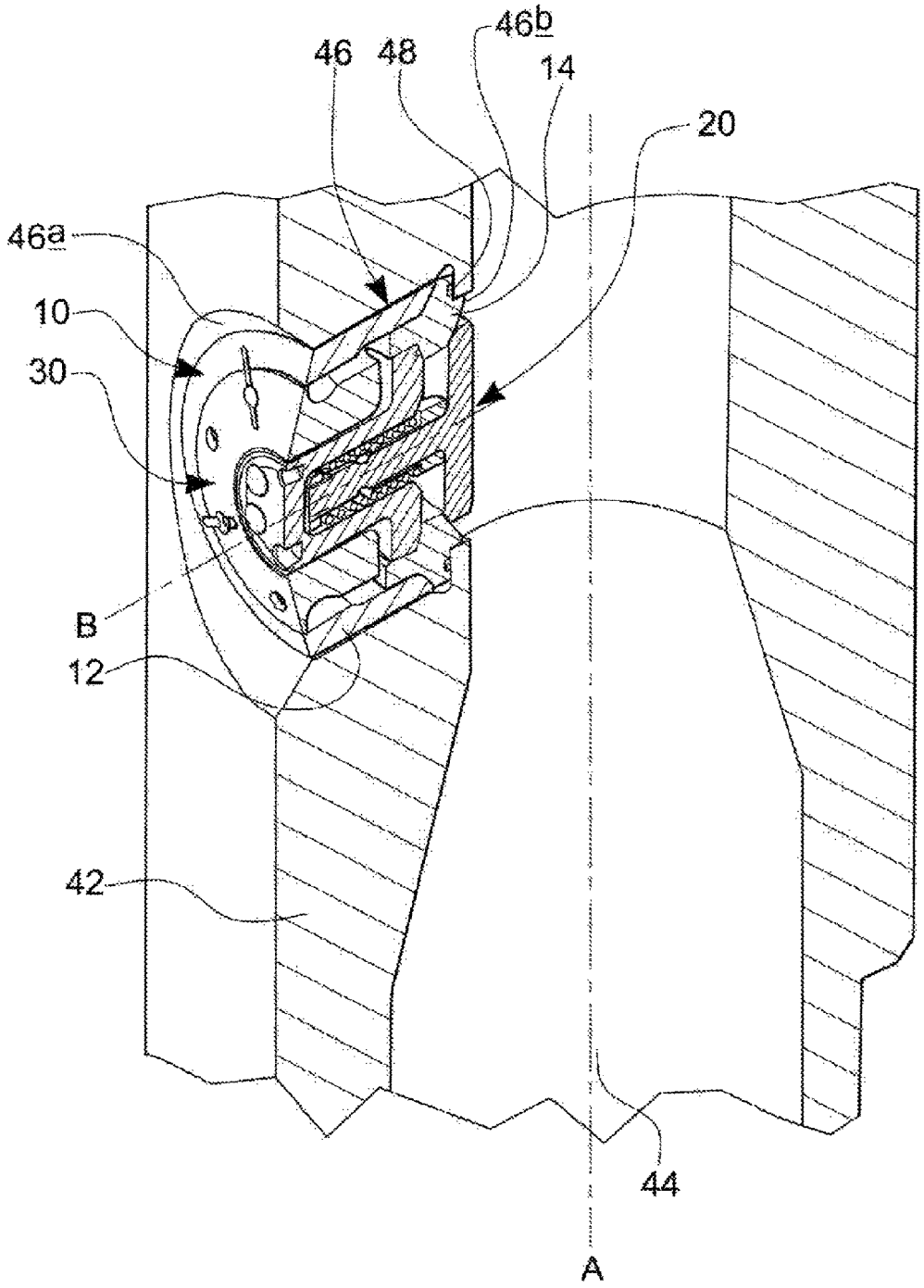
Figure 4A:
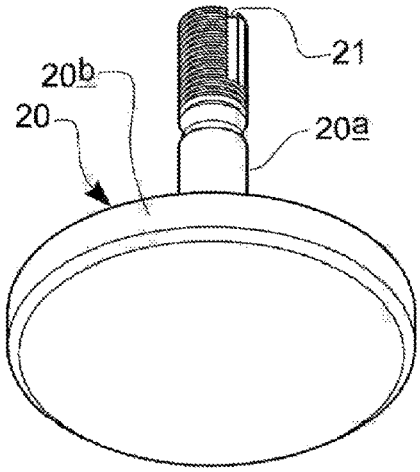
Figure 4B:
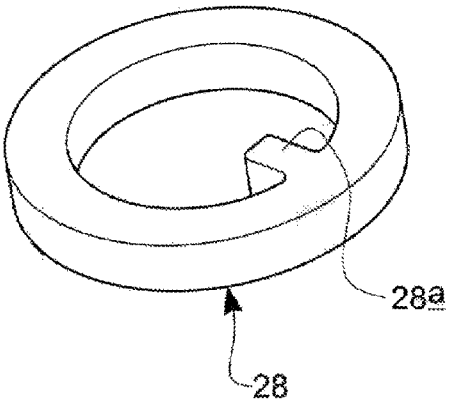
Figure 4C:
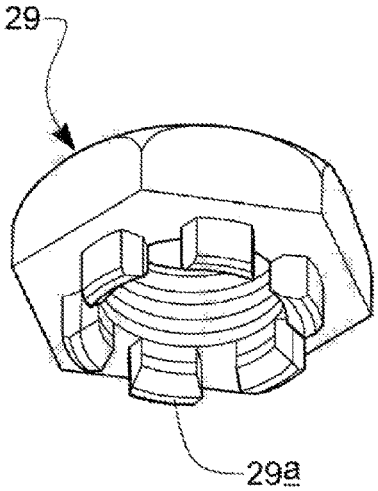
Figure 4D:
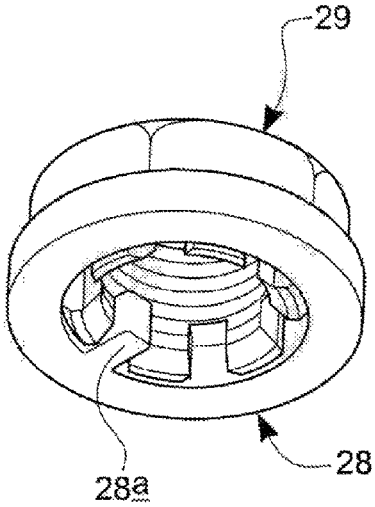

Embodiments of the invention will now be described, by way of example only, with reference to the accompanying figures of which FIG. 1 shows an exploded perspective illustration of a valve assembly according to the invention, FIG. 2 shows a perspective view of a longitudinal cross-section through the valve assembly illustrated in FIG. 1 when assembled, FIG. 3 shows a longitudinal cross-section through a portion of drill pipe including the valve assembly shown in FIGS. 1 and 2, FIG. 4*a* shows a perspective illustration of one embodiment of valve member suitable for use in the valve assembly illustrated in FIGS. 1, 2 and 3, FIG. 4*b* shows a perspective illustration of one embodiment of collar suitable for use with the valve member illustrated in FIG. 4*a*, FIG. 4*c* shows a perspective illustration of one embodiment of nut suitable for use with the valve member and collar illustrated in FIGS. 4*a* and 4*b*, and FIG. 4*d* shows a perspective illustration of the collar and nut illustrated in FIGS. 4*b* and 4*c*.

Referring now to FIGS. 1 and 2, there is shown a valve assembly 10 comprising a valve body 12, and a valve seat 14. The valve body 12 has a generally annular wall which encloses a main passage, and the valve seat 14 is mounted at a first end 12*a* of the valve body 12, a first portion 14*a* of the valve seat 14 extending into the main passage and engaging with a portion of the inside surface of the annular wall, and a second portion 14*b* of the valve seat 14 extending out of the annular wall and engaging with the first end 12*a* of the valve body 12. The first end 12*a* of the valve body 12 is angled at around 45° to the longitudinal axis of the main passage, the first end 12*a* of the valve body 12 engaging with a correspondingly angled face of the second portion 14*b* of the valve seat 14.

The internal diameter of the first portion 14*a* of the valve seat 14 is greater than the internal diameter of the second portion 14*b* of the valve seat 14. Moreover, the second portion 14*b* of the valve seat 14 is provided with an annular seat face 16 which faces away from the valve body 12 and is which is preferably angled at between 30 and 60° (in this example) around 45° to the longitudinal axis of the main passage, the radially outward edge of the seat face 16 being located outside of the volume enclosed by the annular wall of the valve body 12 and the radially inward edge of the seat face 16 extending into the main passage. A sealing element, in this example an O-ring 18, is located in a generally circular groove provided in an end face of the second portion 14*b* of the valve seat 14. This groove is typically machined into the end face of the valve seat 14.

The valve assembly 10 is also provided with a valve member 20, which, in this example is a poppet check valve. The valve member 20 includes a stem 20*a* one end of which is mounted centrally on a disc 20*b* so that the stem 20*a* extends generally normal to the disc 20*b* to a free end of the stem. The valve member 20 is located such that the stem 20*a* extends into the main passage of the valve body 12, whilst the disc 20*b* is at least partially surrounded by the valve seat 14. The diameter of the disc 20*b* is greater than the diameter of the main passage valve body 12 and the diameter of the radially inward edge of the seat face 16, and is less than the diameter of the radially outward edge of the seat face 16. The valve member 20 is thus movable into a closed position, in which the disc 20*b* engages with the seat face 16, providing a generally fluid tight seal which substantially prevents fluid flow along the main passage in the valve body 12.

In order to locate the valve member 20 radially within the main passage of the valve body 12, a mounting part, which allows flow of fluid along the main passage whilst supporting locating the valve member 20, is provided. In this embodiment of the invention, the mounting part comprises radial spokes 22 which extend from the valve seat 14 into the main passage of the valve body 12. Mounted generally centrally on the spokes is an annular support ring 24 which is just slightly larger in internal diameter than the stem 20*a* of the valve member 20, and the stem 20*a* of the valve member 20 extends through this support ring 24. The valve member 20 is biased into the closed position by means of a helical spring 26 which extends between the support ring 24 and an annular collar 28 which is mounted around the free end of the stem 20*a*. In this embodiment of the invention, the collar 28 is retained around the stem 20*a* by means of a nut 29 which, in this example, is secured to the stem 20*a* by means of a screw thread.

The spring 26 is configured such that it is under compression, and pushes the valve member 20 into engagement with the seat face 16. It is therefore necessary to move the valve member 20 against the biasing force of the spring 26 in order to move it out of the closed position to an open position, in which the disc 20*b* of the valve member 20 is spaced from the valve seat 14 so that fluid can flow through the central bore passage via the space between the seat face 16 and disc 20*b*.

One embodiment of valve member, collar and nut assembly is shown in FIGS. 4*a*, 4*b*, 4*c* and 4*d*. In this embodiment, the free end of the stem 20*a* of the valve member 20 is provided with a slot 21 which extends into the stem 20*a* generally parallel to its longitudinal axis. This is illustrated in FIG. 4*a*. The collar 28 is provided with a corresponding tab 28*a* which extends radially inwardly of the collar 28 (illustrated in FIG. 4*b*) so that the collar 28 can only slide onto the stem 20*a* of the valve member 20 when the tab 28*a* is located in the slot 21. Rotation of the collar 28 around the stem 20*a* is therefore significantly restricted by the location of the tab 28*a* in the slot 21.

As illustrated in FIG. 4*c*, one end of the nut 29 is provided with a plurality of teeth or castellations 29*a* which extend parallel to the longitudinal axis of the stem 20*a* when the nut is screwed onto the stem 20*a*. The space between the castellations 29*a* is sufficiently to accommodate the tab 28*a* of the collar 28, so the nut 29 can be locked in place by locating the tab 28*a* between two adjacent castellations 29*a*, as illustrated in FIG. 4*d*.

The valve member/spring/collar and nut assembly is therefore assembled by inserting the stem 20*a* of the valve member 20 through the support ring 24, placing the spring 26 around the stem 20*a*, and then sliding the collar 28 over the stem 20*a* with the tab 28*a* in the slot 21. The nut 29 is then screwed onto the free end of the stem 20*a*, whilst the collar 28 is pushed away from the nut 29 against the biasing force of the spring 26, until the nut 29 is at the desired position along the stem 20*a*. The exact orientation of the nut 29 is adjusted slightly so that one of the gaps between adjacent castellations 29*a* is aligned with the slot 21. The collar 28 is then released, and is pushed by the spring 26 against the nut 29, so that the tab 28*a* becomes trapped between these adjacent castellations 29*a*. Thus, further rotation of the nut 29*a* around the stem 20*a* is substantially prevented, and the nut 29 is locked in the desired position on the stem 20*a*.

The position of the nut 29 can be adjusted (for example to increase or decrease the biasing force exerted by the spring 26 on the valve member 20) or the nut 29 removed by pushing the collar 28 against the biasing force of the spring 26 so that the tab 28*a* is released from between the castellations 29*a*.

By virtue of this arrangement, the nut 29 can be locked in a variable position on the stem 20*a*, unlocking of the nut 29 being resisted by the biasing force of the spring 26.

Although not essential, this embodiment of the invention is also provided with a cap 30 which is provided with a generally circular top part 30*a* from which extends a generally cylindrical wall 30*b* of smaller diameter than the top part 30*a*. The wall 30*b* extends into the main passage of the valve body 12.

The cap 30 is, in use, secured to the valve body 12 by means of bayonet connection formations 32 provided on the exterior surface of the wall 30*b* of the cap 30. In this example, four such bayonet connector formations 32 are provided, and are spaced generally evenly around the wall 30*b* of the cap 30, the spaces between adjacent bayonet connector formations 32 occupying around half of the outer circumference of the wall 30*b* in total. The bayonet connector formations 32 each engage with a corresponding lip formation 34 which extends from the valve body 12 into the main passage. As such, in this example, four lip formations 34 are provided, and these are regularly spaced around the circumference of the interior surface of the valve body 12, occupying less than half of the circumference in total.

The valve assembly 10 may also be provided with one or more locking protrusions which extend diagonally upwardly to the main passage from the underside of the lip formations 34. In this case, for each locking protrusion, a corresponding recesses, large enough to accommodate the end of the locking protrusions, is provided in the centre of the bayonet connector formations 32 of the cap 30.

The cap 30 may thus be secured to the valve body 12 as follows. The cap 30 is orientated so that each of the bayonet connector formations 32 is aligned with one of the gaps between adjacent lip formations 34. The cap 30 is inserted into the main passage of the valve body 12 until the top part 30*a* is slightly below the first end 12*a* of the valve body 12, and is then rotated through around 45° until each of the bayonet connector formations 32 engages with one of the lip formations 34. Where locking protrusions are provided, each locking protrusion is then located in the corresponding recess provided in the bayonet connector formation 32. Engagement of the bayonet connector formations 32 with the lip formations 34 of the valve body 12 thus prevents withdrawal of the cap 30 from the valve body 12, with the location of the locking protrusion(s) in the recess(es) in the bayonet connector formations 32 ensuring that the cap 30 is correctly aligned relative to the valve body 12 to achieve maximum contact between the bayonet connector formations 32 and the lip formations 34, and to impede rotation of the cap 30 relative to the valve body out of that alignment.

To assist in achieving the rotation required to engage the bayonet connection formations 32 with the lip formations 34, the top part 30*a* of the cap 30 is provided with a plurality of apertures 36 into which a special tool, may be inserted. The cap 30 may thus be rotated by rotation of the tool. In this example, eight such apertures 36 are provided, and thus the tool is provided with eight corresponding pins. In order to assist a user in ascertaining when the cap 30 is correctly aligned relative to the valve body 12, the exterior surfaces of the lip formations 34 are provided with corresponding apertures 38 which, when the cap 30 is in the correct alignment, line up with the apertures 36 in the cap 30. Thus, when the cap 30 is correctly aligned relative to the valve body 12, the pins of the tool can slot into the apertures 38 in the lip formations 34. The user will feel this as a sudden movement of the tool in towards the valve body 12, and can therefore be reassured that the alignment of the cap 30 is correct and no further rotation is required.

Alternatively, one or more of the bayonet connector formations 32 may be provided with an anti rotation feature so that the cap 30 can only be rotated a certain amount (such as 45 degrees) before coming to a hard stop. This may comprise a stop formation which extends from the outer part 31*a* of the cap 30 between the bayonet connector formations 32 and the top 30*a* of the cap 32, and which is aligned with one end face of the bayonet connector formation 32. The anti rotation feature is therefore brought into engagement with an edge of one of the lip formations 34 when the cap 30 has been rotated by the amount required to bring the bayonet connector formation 32 into complete alignment with the lip formation 34, further rotation of the cap 30 therefore being prevented.

In this example, the mating surfaces of the bayonet connector formation 32 and the lip formations 34 are angled at around 45° to the longitudinal axis of the main passage in the valve body 12, the radially inward portions of the mating surfaces being closest to the first end 12*a* of the valve body 12.

Whilst the cap 30 may be a unitary structure, in this example it is made in two parts, an outer part 31*a*, which provides the outer periphery of the top 30*a* and the portion of the wall 30*b* including the bayonet connector formations 32, and an inner part 31*b* which provides the central portion of the top 30*a* and a lower portion of the wall 30*b* which has a circumferential groove in which sealing element, in this example an O-ring 40, is located. The outer part 31*a* and inner part 31*b* are fastened together by means of engagement of a screw thread which is provided around the exterior of the inner part 31*b* and the interior of the outer part 31*a*.

The apertures 36 used to rotate the cap 30 to bring the bayonet connector formations 32 into locking engagement with the lip formations 40 are provided in the outer part 31*a* of the cap 30. The provision of such a two part structure is therefore advantageous, as, during this rotation of the outer part 31*a*, engagement of the screw threads of the outer and inner parts 31*a*, 31*b* causes the outer part 31*a* to move slightly towards the first end 12*a* of the valve body 12, thus bringing the bayonet connector formations 32 into tight engagement with the lip formations 34, and prevents any substantial movement of the cap 30 in the valve body 12.

It should be appreciated, however, that other fastening means may be used to retain the cap 30 in the valve body 12. For example, a screw thread or any other type of quick connection method may be used instead.

In this example, as the diameter of the top part 30*a* of the cap 30 is less than the internal diameter of the first end 12*a* of the valve body 12, the top part 30*a* of the cap 30 can be inserted into the main passage of the valve body 12 at the second end 12*b* of the valve body 12. The internal diameter of the second portion 14*b* of the valve seat 14 is, however, less than the external diameter of the wall 30*b* of the cap 30. Thus, the second portion 14*b* of the valve seat 14 acts as a stop preventing the cap 30 from being pushed through the main passage completely.

When the cap 30 is correctly positioned in the valve body 12, the bayonet connector formations 32 lie between the lip formations 34 and the second portion 14*b* of the valve seat 14, and the O-ring 40 engages with the second portion 14*b* of the valve seat 14 to provide a substantially fluid tight seal. This ensures that the cap 30 provides a secondary seal preventing fluid flow through the main passage of the valve body 12 in case the seal provided by the valve member 20 fails.

The valve seat therefore has a second seat face, and in this embodiment of the invention, the second seat face is also annular and oriented at an angle of between 30 and 60° to the longitudinal axis of the main passage in the valve body 12.

It should be appreciated that the angle of orientation of both the first and second seat faces is not critical. Either one or both could be generally perpendicular to the longitudinal axis of main passage in the valve body 12 (although this is structurally inefficient), or could be oriented at an angle which is closer to being parallel to the longitudinal axis of the main passage in the valve body 12 (although in this case slight variations on the seat diameter would give rise to a marked variation in the position of the valve member or cap when engaged with the seat face). The applicant has found that an angle of around 60° provides a reasonable compromise between these conflicting considerations, as it offers better fluid flow properties and should have less erosion on the sealing face than a version with a lower angle. The problem of variation in valve member/cap position associated with this steeper angle, can be mitigated by the use of tighter manufacturing tolerances, and for the first seat face, the steeper angle allows the disc of the valve to be slightly thinner as there is less bending stress on it and more compressive stress.

The valve assembly 10 is, in use, mounted in a side port 46 provided in a portion of drill pipe 42, or a sub for insertion in a drill pipe, as illustrated in FIG. 3. The drill pipe 42 has a main passage 44 which extends generally parallel to its longitudinal axis A, the side port 46 extending through the drill pipe, in this example, generally perpendicular to its longitudinal axis, thus connecting the main passage 14 with the exterior of the drill pipe 42. The valve assembly 10 is located in the drill pipe 42 with the second end 12*b* of the valve body 12 generally flush with the external surface of the drill pipe 42, and valve seat 14 and valve member 20 lying at least predominantly within the side port 46, so that the valve assembly 10 does not restrict, to any significant degree flow of fluid along the main passage 44 of the drill pipe 42.

The valve assembly 10 is, in this example, secured to the drill pipe 42 by means of a screw thread provided in the external surface of the valve body 12 and the wall of the drill pipe 42 surrounding the side port 46.

The face of the drill pipe 24 surrounding the side port 46 is provided with a radially inwardly extending step or shoulder 48 which provides a seating face for the valve assembly 10 which, in this example, extends generally perpendicular to the longitudinal axis B of the side port 46. The shoulder 48 extends between an external portion 46*a* of the side port 46 which has a diameter greater than the outer diameter of the valve body 12 and valve seat 14, and an internal portion 46*b* of the side port 46 which has a diameter less than the outer diameter of the valve body 12 and valve seat 14 but greater than the diameter of the disc 20*b* of the valve member 20. The valve assembly 10 is therefore inserted into the side port 46 from the exterior of the drill pipe 42 until the valve seat 14 comes to rest on the shoulder 48.

The second portion 14*b* of the valve seat 14 is thus captured between the valve body 12 and the shoulder 48, and so the positioning of the valve seat 14 between the valve body and shoulder 48 serves as the mechanism for securely retaining the valve seat 14 in the valve assembly 10. Moreover, by tightening the screw thread between the valve body 12 and the drill pipe 42, a sufficient compressive force may be applied to the valve seat 14 to produce a substantially fluid tight seal between the valve assembly 10 and the drill pipe 42. In this example, this substantially fluid tight seal is provided by the engagement of the sealing element, O-ring 18, provided on the valve seat 14, with the shoulder 48. Thus, flow of fluid between the exterior of the valve assembly 10 and the face of the drill pipe 42 surrounding the side port 46 is substantially prevented.

In an alternative embodiment of the invention, the valve body 12 may be provided with a plurality (for example four) locking studs which each pass through a threaded aperture extending radially outwardly through the valve body 12 from the main passage to the exterior of the valve body 12. In this case, each locking stud is threaded and the interior end is provided with a head having a hexagonal recess which may be engaged with an Allen key. To secure the valve assembly 10 to a drill pipe 42, the valve body 12 is inserted into the side port 46 with the locking studs retracted so that they do not extend beyond the exterior surface of the valve body 12. The valve body 12 is then rotated in the side port 42 to ensure that the locking studs are aligned with corresponding apertures provided in the wall of the side port, and an Allen key engaged with the head of each stud in turn and used to screw the stud into the apertures in the drill pipe 42. Removal of the valve assembly 10 from the side port is therefore prevented. It will be appreciated, however, that such locking studs may be provided in addition to a screw thread connection. It will be appreciated, appreciated that bolts, or any other appropriate fastening means could be used.

During the usual operational mode of the drill pipe there exists a pressure inside the main passage 44 of the drill pipe 42 that forces the valve member 20 against the seat face 16. To use the side port 42, the cap 30 is removed, Once the cap 30 is removed an adapter (not shown) provided with corresponding bayonet connector formations can be engaged with the lip formations 34 of the valve body 32. The adapter is provided with appropriate seals so that there will be a substantially fluid tight seal between the valve assembly 10 and the adapter. The seal could be a similar O-ring to the O-ring 40 on the cap 30 or a piston type seal which seal on the parallel cylindrical face of the first portion 14*a* of the valve seat 14 adjacent to the second seat face. Fluid pressure can then be supplied through this adapter into the main passage of the valve assembly, and this will start lifting the disc 20*b* from the seat face 16 once the applied pressure exceeds the internal pressure in the main passage 44 of the drill pipe 42 by an amount which is sufficient to overcome the biasing force of the spring 26 and. At this point the valve assembly is in the open position, and fluid will pass through the side port 42 into the main passage 44 of the drill pipe 42.

Once the flow is stopped, and the pressure in the adapter is reduced below the pressure in the drill pipe 42 the valve 20 will close. The spring 26 will always ensure that the valve is held in a closed position at all times when there is no pressure applied from the central of the drill pipe 42 and there is no pressure applied externally.

If the fluid pressure in the adapter is balanced relative to the fluid pressure in the drill pipe 42, it will be appreciated that the fluid pressure in the adapter may not be sufficient to move the valve member 20 to the open position, in which case, the adapter may be provided with a mechanical actuator to push the valve member 20 off the seat face 16 to the open position. The mechanical actuator may automatically do this, when the adapter is secured to the drill pipe, or manual operation of the actuator may be required.

It will be appreciated that when the valve assembly 10 is open, and there is rapid flow of fluid along the side port 46, this high velocity fluid flow can cause significant erosion and corrosion of the valve seat 14, in particular of the seat face 16 and radial spokes 22. This erosion/corrosion is particularly undesirable as it can be detrimental to the ability of the seat face 16 to provide an effective seal with the valve member 20, to the ability of the spokes 22 to support and centralise the valve member 20.

By making the valve seat 14 and valve body 12 as two separate parts, the valve seat 14 can be replaced when too eroded/corroded, without the need to replace the entire valve body 12 too. By only needing to replace and ship the valve seat 14, significant cost savings, simplified maintenance logistics, and a reduction in material disposables may be achieved.

The two part design also permits an optimized material selection for the components of the valve assembly 10 which are exposed to and most susceptible to erosion and corrosion from the high velocity fluid flow, such that wear and corrosion resistance is maximized. Where the valve body and valve seat are formed from a single part, as in the prior art, it is difficult to select a single stainless steel grade to achieve the correct balance of ductility and tensile strength for that part. As such, where the valve assembly is constructed as in the prior art, the valve housing is typically made from a high strength steel which is chemically treated to improve its corrosion resistance. For example, the treatment may be liquid phase nitriding in which a black oxide layer is applied as a protective coating. Moreover, since the metal-to-metal seal between the valve seat and the valve member undergoes significant erosion due to the abrasive nature of the high velocity pressurised drilling fluid passing through the valve assembly when in use, the seal face is typically given a secondary coating with a hard facing material. For example, a thin hard metal/ceramic layer may be applied using high velocity oxy fuel. Whilst this procedure can increase resistance to erosion and corrosion, the treatment process represents a significant portion of the manufacturing time and cost. Moreover, under the abrasion that occurs from the flow of pressurized drilling fluid, this coating can be eroded away, and the erosion actually then increases the risk of corrosion.

The inventive two part design allows optimal selection of materials more applicable to their function within the valve assembly 10. For example, high strength steel with the ductility specifications required by API 7-1 can still be deployed for the valve body 10, valve member 20 and protector cap assembly 30. As such, these components can still satisfy the mechanical properties required to form a unified pressurized shell with the drill string while simultaneously meeting ductility and tensile strength requirements of the drill pipe 42 (as per the API requirements). The valve seat 14 is not required to meet the mechanical specifications of the drill pipe 42, so this component can be made of a different material more suited to the conditions it is exposed to. This allows the valve seat 14 to be made from a material which has inferior mechanical properties (such as ductility) in comparison to the high strength steel discussed above, but which is sufficiently corrosion resistant to eliminate the need for an expensive and time consuming chemical treatment or coating process. The valve seat 14 may be made from stainless steel, for example.

If desired, a process known as gas phase ion-nitriding can be deployed to provide increased hardness to the metal utilized in the valve seat 14. Ion nitriding is an industrial surface hardening treatment for metallic materials, and involves a nitrogen rich gas to come into contact with the heated work piece where it disassociates into nitrogen and hydrogen. The nitrogen then diffuses onto the surface of the material creating a nitride layer, and the thickness and phase constitution of the resulting nitriding layers can be selected and the process optimized for the particular properties required for the material.

The utilization of a stainless steel grade material for all sealing areas, especially in environments where a high velocity pressurized fluid flow tends to strip away corrosion protective coatings, is an advantage for general corrosion resistance and reliability for the proposed invention. It has been revealed in field operations that valves which remain within the sub/drillpipe body between runs corrode quite quickly given the materials and coatings used with the current design. Thus the ability to replace the coated valve component with a specific grade of stainless steel would greatly reduce or eliminate this problem.

It should be appreciated, however, that the conditions to which the valve seat 14 is subjected mean that the degradation of this part cannot, in practice, be eliminated simply by the selection of a corrosion resistant material such as stainless steel. In fact, the inferior mechanical properties of the material selected for the valve seat 14 may actually result in an increased erosion rate. The ability to replace, relatively easily and quickly, a worn valve seat 14 mitigates this potentially increased erosion rate, however.

Careful selection of the contact angle of the metal-metal sealing face between the disk 20*b* of the valve member 20 and the seat face 16 on the valve seat 14 may further reduce the rate of wear on the flow areas encompassed within the valve seat 14. This angle may be optimized through computational fluid dynamics modelling. The aim of the optimised angle is to allow fluid to flow in a more direct fashion through the space between the seat face 16 and disk 20*b*, as this should reduce the amount of turbulence in the flow of pressurized fluid through the bore of the valve housing which should, in turn, reduce the erosion of the spokes 22 and critical sealing faces of the valve assembly 10. The contact angle of the sealing face may be, but is not limited to, 30 to 60 degrees.

Furthermore, the degree of erosion is reduced by the design optimization of the spoke profile of the annular flange located in the valve body insert. This optimal profile is a compromise between the mechanical strength requirements to resist the pressure of the fluid flow, and the shape optimises for fluid flow. Advantageously the spokes are provided with fully rounded upper and lower faces, and a small transition fillet between the spoke and the outside diameter of the flow area.

In another embodiment of the invention the valve member 20 is provided with a secondary sealing element which is made from a different, in particular a flexible material, and which provides a secondary barrier to flow through the side port 46 in addition to the metal-metal seal formed between the disk 20*b* and seat face 16. In this embodiment of the invention (not illustrated), a groove is machined into the side profile of the disk 20*b* of the valve member 20 in order to permit the insertion of a sealing element such as a polyurethane seal. The sealing element engages with the seat face 16 when valve member 20 is in the closed position. The groove is machined with ample steel in the disk 12*b* above and below the sealing element to prevent deformation of the valve member 20 during high rate fluid flows. Under specific temperature and pressure conditions, the sealing element may increase the capability of the valve member 20 to seal around or on any debris which may exist in the metal-metal seal. The elastomeric sealing element may be particularly advantageous when the valve assembly is used at low pressures, for example when used in gas service, which is where the metal-metal seal can be unreliable. It would also allow greater erosion of the metal-metal seal before sealing is compromised, or possibly mean the metal-to-metal seal no longer needs to be laboriously lapped to a matched pair, with the elastomeric sealing element forming the main seal.

Additionally, the groove is advantageously designed with enough depth such that resistance to the deformation of the disc 20 will prevent the sealing element from becoming dislodged, which would eliminate its effectiveness as a sealing barrier during pressurized fluid flow.

Additional embodiments of the invention can be expanded to include the application of any replaceable metal insert designed to accommodate the rapid wear of sealing faces and structural members in any valve configuration used in side port-continuous circulation systems. Such a replaceable insert allows only the worn structures in the valve to be replaced while continuing to deploy the preserved main body valve structure that can still function with integrity. This replaceable insert may also be made out of a different material (silicon nitride for example) from the rest of the valve assembly.

When used in this specification and claims, the terms "comprises" and "comprising" and variations thereof mean that the specified features, steps or integers are included. The terms are not to be interpreted to exclude the presence of other features, steps or components.

The features disclosed in the foregoing description, or the following claims, or the accompanying drawings, expressed in their specific forms or in terms of a means for performing the disclosed function, or a method or process for attaining the disclosed result, as appropriate, may, separately, or in any combination of such features, be utilised for realising the invention in diverse forms thereof.

The invention claimed is:

1. A drilling system including a tubular element and a valve assembly for use controlling flow of fluid into the tubular element, the valve assembly having a valve body, a valve member and a valve seat, wherein:

a) the valve body has a main passage;

b) the valve member is movable between a closed position in which the valve member engages with a seat face of the valve seat to substantially prevent flow of fluid along the main passage, and an open position in which the valve member is spaced from the seat face; and c) the valve seat is a separate part to the valve body wherein, the tubular element has a wall enclosing a main passage and a side port which extends through the wall from the exterior of the tubular element to the main passage, the side port includes a larger cross-sectional area portion and a smaller cross-sectional area portion, there being a shoulder in the portion of the wall of the tubular element surrounding the side port which extends between the larger cross-sectional area portion and the smaller cross-sectional area portion, and the valve seat is clamped between the valve body and the shoulder.

2. The drilling system valve according to claim 1, wherein the valve assembly further includes a cap, the valve body being provided with cap locking formations suitable for engagement with corresponding locking formations provided on the cap when the cap is located at least partially in the main passage, the engagement of these locking formations substantially preventing movement of the cap out of the main passage.

3. The drilling system valve member according to claim 2, wherein the valve seat has a further seat face which engages with a sealing part of cap to provide a substantially fluid tight seal between the cap and the valve seat when the cap is retained in the main passage of the valve body by engagement of its locking formations with the cap locking formations of the valve body.

4. The drilling system according to claim 1, wherein the valve body is provided with means for securing the valve body in an aperture provided in the tubular element.

5. The drilling system valve assembly according to claim 1, wherein the valve seat is generally annular, and the support part comprises at least one spoke which extends radially into the generally circular space enclosed by the valve seat.

6. The drilling system according to claim 1, wherein the valve assembly is mounted on or at least partially within the side port so that movement of the valve member to the closed position substantially prevents flow of fluid through the side port.

7. The drilling system according to claim 1, wherein the valve body includes anchor formations which are engaged with corresponding formations on the tubular element to restrict movement of the valve body relative to the tubular element.

8. The drilling system according to claim 1, wherein the valve seat has a sealing face which is in sealing engagement with the tubular element to substantially prevent flow of fluid from the main passage in the tubular element between the valve assembly and the tubular element.

9. The drilling system according to claim 1, wherein the maximum outer diameter of valve assembly is less than the diameter of the larger cross-sectional area portion and greater than the diameter of the smaller cross-sectional area portion.

10. The drilling system according to claim 1, wherein the valve seat engages with the shoulder so that the shoulder supports the valve assembly in the side port, a substantially fluid tight seal being provided between the shoulder and the valve seat.

11. The drilling system according to claim 1, wherein the shoulder extends generally perpendicular to the longitudinal axis of the side port.

12. The drilling system according to claim 1, wherein the valve body is located between the valve seat and the exterior of the tubular element.

13. The drilling system according to claim 1, wherein the tubular element is a drill pipe or sub.

14. An assembly comprising:

a rod having a longitudinal axis;

a support part;

a resilient biasing element;

a nut, the nut being mounted on a screw thread around the rod;

a locking collar mounted around the rod such that the biasing element extends between the support part and the locking collar, wherein the locking collar has a first locking formation which engages with a corresponding locking formation of the rod to substantially prevent rotation of the locking collar around the rod, the biasing element pushing the locking collar into engagement with the nut so that at least one locking formation on the nut engages with a second locking formation on the locking collar, and, as a result, the locking collar substantially prevents further rotation of the nut about the rod.

15. The assembly according to claim 14, wherein the locking formation of the nut comprise two or more teeth or castellations extending from the nut generally parallel to the longitudinal axis of the rod.

16. The assembly according to claim 14, wherein the locking formation of the rod comprises a slot extending along an end of the rod generally parallel to its longitudinal axis, whilst the first locking formation of the collar comprises a protruberance or tab which extends radially inwardly of the locking collar into the slot.

17. The assembly according to claim 14, wherein the first and second locking formations of the locking collar are integrally formed in a single part of the locking collar.

18. The assembly according to claim 14, wherein the biasing element comprises a helical spring.

19. A valve assembly comprising:

a valve seat;

a valve member movable into and out of engagement with the valve seat to open or close the valve assembly; and the assembly according to claim 14, wherein the valve member comprises the rod, the support part is fixed relative to the valve seat, and the biasing element biases the valve member into or out of engagement with the valve seat.

20. The valve assembly according to claim 19, wherein the valve member is biased into engagement with the valve seat by means of the resilient biasing element.

21. The valve assembly according to claim 19, wherein the valve member further comprises a disc which is mounted on one end of the rod so that the rod extends centrally from and generally normal to the disc.

22. The valve assembly according to claim 21, wherein the valve assembly is configured such that it is the disc that engages with the valve seat when the valve member is engaged with the valve seat.

* * * * *